United States Patent [19]

Wankel

[11] Patent Number: 4,490,101

[45] Date of Patent: Dec. 25, 1984

[54] INTERNALLY AXED ROTARY PISTON ENGINE

[76] Inventor: Felix Wankel, Bregenzer Strasse 82, D-8990 Lindau, Fed. Rep. of Germany

[21] Appl. No.: 469,625

[22] Filed: Feb. 25, 1983

[30] Foreign Application Priority Data

Mar. 3, 1982 [CH] Switzerland ..... 1302/82
Nov. 17, 1982 [CH] Switzerland ..... 6708/82

[51] Int. Cl.[3] ..... F02C 3/02; F03C 3/00

[52] U.S. Cl. ..... 418/164; 418/191; 418/183

[58] Field of Search ..... 418/164, 165, 166, 191, 418/196, 183

[56] References Cited

U.S. PATENT DOCUMENTS 805,552 11/1905 Vom Hofe ..... 418/191
1,298,140 3/1919 Workman ..... 418/166
2,215,096 9/1940 Fanberg ..... 418/191
3,847,123 11/1974 Vierling ..... 418/164
3,940,925 3/1976 Kelly ..... 418/191

FOREIGN PATENT DOCUMENTS 180927 2/1907 Fed. Rep. of Germany ..... 418/166

*Primary Examiner*—Michael Koczo
*Assistant Examiner*—John J. McGlew, Jr.
*Attorney, Agent, or Firm*—Toren, McGeady and Stanger

[57] ABSTRACT

An internally axed crankless piston engine wherein a piston rotor has at least one piston which moves through a circular annulus defined between a fixed inner casing and a fixed radially outer casing. A stopping piston is provided which defines the terminus of the annulus at one point on its circumference and an inflow duct issues into the annulus via an opening in the fixed inner wall of the inner casing or is arranged in the fixed radially outer casing wall adjacent to the stopping rotor while adjacent to the stopping rotor an outflow duct is provided in a fixed radially outer facing wall of the outer casing.

4 Claims, 14 Drawing Figures

INTERNALLY AXED ROTARY PISTON ENGINE

BACKGROUND OF THE INVENTION

The invention relates to an internally axed crankless rotary piston engine having a piston rotor, whereof at least one piston of the piston rotor moves through a circular annulus formed as the gap between a fixed inner wall and a sealing rotor, which defines the termination of the annulus at one point on its circumference.

The technical literature contains a large number of proposals relating to the construction of rotary piston engines and these extend back over several centuries. However, in modern times, relatively few rotary piston engines, such as e.g. the Wankel engine or the Roots blower have become widely used. The book "Einteilung der Rotationskolbenmaschinen", by Felix Wankel, Deutsche Verlags-Anstalt, Abteilung Fachverlag, Stuttgart, 1973, (English edition first published in 1965 by ILIFFE BOOKS LTD., Dorset House, Stamford Street, London, S.E. 1 under the title "Rotary Piston Machines") while not purporting to be exhaustive, surveys a large number of different known constructions and contains a proposal for their systematic classification. On the basis of existing literature, the advantages and disadvantage of these engines can only be evaluated in more detail in individual cases, because the manufacture of prototypes involves considerable expenditure. Numerous earlier constructions only appear to be worthwhile, when account is taken of the existing power requirements or the low speeds of movement, e.g. when used in the form of a steam engine.

In a rotary piston engine of this type known from German Pat. No. 180,927, dated 1905, fuel is supplied through narrow ducts in the side walls of the engine and flows via narrow ducts in the pistons and a rotating closed cylinder freely to the outside. The driving connection between the piston rotor and the stopping rotor is by frictional contacts between the two.

The problem of the prior art sought to be overcome by the present invention is to find an engine which is in particular suitable as a driver and supercharger for an internal combustion engine, which combines the advantages of a turboengine and those of a rotary piston engine in that, despite its small size, it is suitable for high through-feed rates and also has a greater efficiency than said engines as a result of lower flow losses and smaller clearances.

SUMMARY OF THE INVENTION

According to the invention, this problem is solved in connection with a rotary piston engine of the aforementioned type in that the inflow duct issues into an annulus via an opening in a fixed inner wall, or is arranged in a fixed, radially outer casing wall adjacent to the sealing rotor, while adjacent to the sealing rotor the outflow duct is provided in a fixed, radially outer facing wall.

The arrangement of the inflow duct in the fixed inner wall of the annulus is particularly advantageous if the engine is to be used as a supercharger or compressor, because this leads to a centrifugal machine-like flow through the engine and its annulus. The supply opening can be made particularly wide in the circumferential direction. In the axial direction, the openings of the ducts into the annulus can be at least approximately the same as the axial length of the piston. As the engine can be very long axially compared with its diameter, correspondingly long openings can be obtained, so that low flow resistances occur in the medium flowing through the engine.

As is shown in FIG. 1 of German Pat. No. 180,927, the sealing rotor has an effective external diameter which corresponds to half the external diameter of the external rotor, at double the rotating speed of the stopping rotor compared with the piston rotor, so that as a result of such special kinematics, the two circumferentially facing opening edges of the recess provided in the sealing rotor can be in permanent sealing contact with the piston during the passage thereof. This ensures that the fuel or conveyed medium cannot pass through the recess or sealing rotor from the inflow side to the outflow side of the engine or vice versa.

As a result of the aforementioned internally axed arrangement of the sealing rotor relative to the piston rotor in accordance with the terminology used in the aforementioned book, an approximately egg-shaped, common, round flow cross-sectional shape is obtained between the sealing rotor and the inner wall of the annulus. A favorable flow guidance of the fuel or conveyed medium through the engine takes place by directing the at least one flow duct provided on the outer casing wall tangentially to the outer circumference of the sealing rotor and the inner wall of the annulus.

As the rotary piston engine according to the invention is crankless, so that the rotors rotate about fixed geometrical axes, the rotors can operate at very high rotation speeds. However, hitherto no suitable means were known for providing a suitable bearing arrangement for the selected internally axed constructions of the external rotor, because on mounting the rotors at their two axial ends, the bearing of the external rotor must surround that of the internal rotor. According to the prior art of German Pat. No. 180,927, this difficulty was overcome in that the two axial ends of the sealing rotor has no bearings, i.e. journals or the like, and instead is enclosed over part of its circumference by a circular recess of the fixed casing. In the same way, the driving transmission between the two rotors must take place by rolling against one another with frictional contact. It is obvious that this driving transmission is not accurate as a result of the possible slip and was only suitable for contemporary speeds of movement of steam engines.

According to an advantageous development of the present invention, it is proposed to provide the external rotor with at least one circularly curved path surrounding the shaft of the sealing rotor and which is mounted by a plurality of bearing means, preferably comprising a roller arranged in a spaced manner in the direction of movement and which are fixed to a common body. This common body can be secured to the fixed outer casing and consequently stretches into the area surrounded by the path, so that it can also be used for the bearing of the sealing rotor shaft. Through the use of individual bearing means, the sealing rotor shaft can be arranged between the same in the circumferential direction. This use of a conventional sliding or antifriction bearing with a diameter corresponding to said path would not be appropriate as a result of the high sliding or rolling speeds. However, the use of rollers as bearing means permits higher rotational speeds with a lower frictional resistance.

The various features of novelty which characterize the invention are pointed out with particularity in the claims annexed to and forming a part of this disclosure.

For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 6:
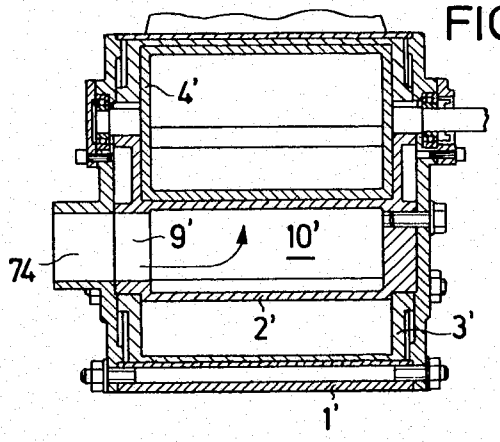
FIG. 6 is an axial section through the driver shown in FIG. 5, FIGS. 7 and 8 are radial sections taken in the vicinity of a stopping rotor engaging with a piston to illustrate the kinematics of the engagement phase.

Referring now to the drawings, there is depicted a rotary piston engine in accordance with the invention operating as a driver with rotational positions according to FIGS. 1*a* to 1*f* and having a fixed outer casing 1 and a fixed inner casing 2 between which are enclosed a piston rotor 3 and a sealing rotor 4. An annulus 5 is defined between outer casing 1 and inner casing 2. Outer casing 1, the wall of inner casing 2, the annulus 5 enclosed between them and the piston rotor 3 have the same geometrical axis, so that pistons 6 and 7 move through the annulus 5 in sealing contact with the outer and inner casings 1, 2. The rotation and feed direction is indicated by arrow 8.

The medium to be conveyed which, when using the engine as a supercharger for an internal combustion engine, is air, is sucked over the internal casing 2 from the lateral outside of the engine via intake ports 9 and then is fed in a centrifugal blower-like manner radially via an opening 10 in the casing inner wall to the outside into annulus 5. The lateral arrangement of intake ports 9 is apparent from the axial sectional view of FIG. 6, which corresponds both to the embodiment of FIGS. 1*a* to 1*f* and that of FIG. 5.

Figure 1B:
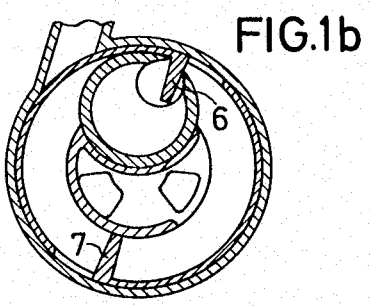
FIGS. 1*a* to 1*f* are radial sectional through a first embodiment of a rotary piston engine operating as a supercharger showing several successive rotational positions.
Figure 1D:
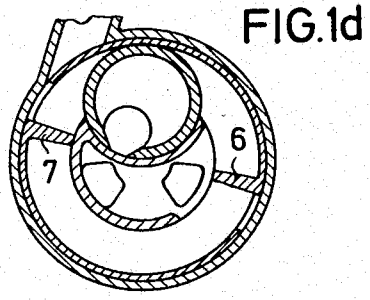
Figure 1F:
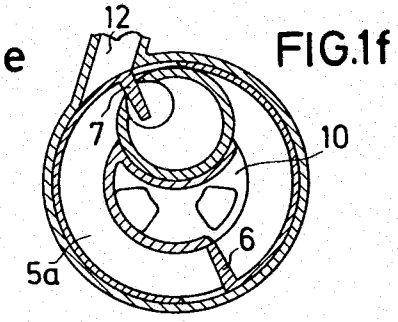
Figure 1A:
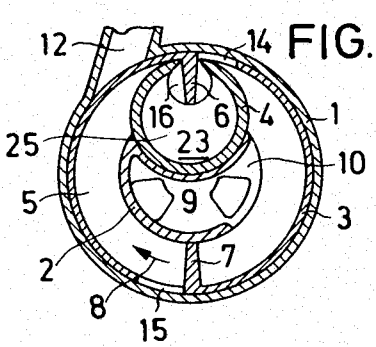
Figure 1C:
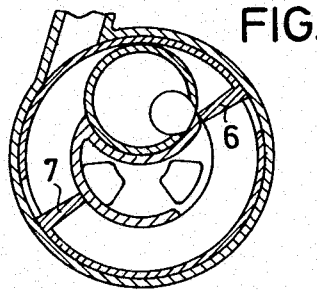

The opening 10 in the casing inner wall extends axially to the greatest possible extent over the axial length of the engine, as can be gathered from FIG. 6 and in the circumferential direction it has a considerable width, starting on the circumference of the sealing rotor 4 and extending up to a rotation position of piston 6 corresponding to FIG. 1*f*, in which the diammetrically facing second piston 7 is shown as having just passed the outlet port 12, so that at this instant compression can start in the sealed part 5*a* of the annulus. FIGS. 1*a* to 1*f* show how the cylindrical circumferential part of piston rotor 3 opens and closes the outlet port 12. The rotor has openings 14, 15 and in the open position, one of the rotor openings 14, 15 facing the piston is located opposite to outlet port 12, corresponding to FIG. 1*e*.

Figure 1E:
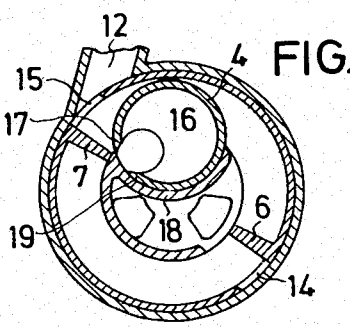

Following onto the rotational position according to FIG. 1*e*, piston 7 enters a recess 16 of sealing rotor 4, at the time when the leading lateral edge 17 of recess 16 loses sealing contact with a concave, circular, inner casing wall 18. Piston 7 penetrates recess 16 in such a way that the latter can no longer open towards annulus 5. During the further movement of piston 7, the leading edge 17 of sealing rotor 4 slides along the planar, front lateral face of the piston, while a trailing edge 19 of the recess slides along the back, planar lateral face of the piston. The planar lateral faces of the piston are made possible due to the kinematics resulting from the diameter and speed ratio of 2:1 between the diameter of the sealing rotor 4 and the internal diameter of the piston rotor 3, because in the case of a relative rolling movement of the inner circle in an outer circle of double the diameter, one point of the inner circle moves on a straight line relative to the outer circle.

Figure 7:
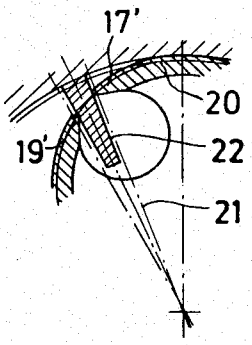
Figure 8:
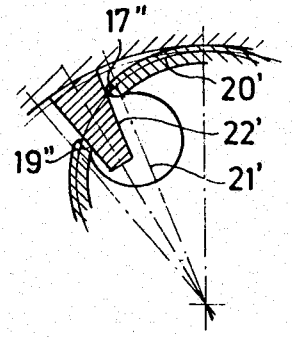

In FIGS. 1*a* to 1*f*, the opening edges 17, 19 of recess 16 of sealing rotor 4 are shown with a sharp-cornered configuration. However, to reduce wear on these edges, they are advantageously rounded, e.g. in accordance with the embodiments of FIGS. 7 and 8. The center of the rounded portion of the edges 17', 19', 17'', 19'' in this case occurs at the intersection points between the rolling circle 20 and an equidistant 21 with a spacing of the radius of curvature to the piston lateral face 22. The gap between edges 17, 19 of recess 16 of the sealing rotor corresponds to a toothed space of a toothed rim for the engagement of the teeth or the piston of a piston rotor comparable to a hollow gear.

For the passage of the piston through recess 16 in the sealing rotor, theoretically a single recess would suffice, which was accurately adapted to the size of the piston and the necessary movement space for the latter, like recess 16 of FIGS. 1*a* to 1*f*. However, this is only located in the planar side walls of the sealing rotor, whereof only a side wall 23 is visible in FIGS. 1*a* to 1*f*. However, to avoid squeezing flows between the curved boundary wall of the recess of the sealing rotor and the piston, the rotor is provided with a yielding or deflection space 25. In the represented embodiment, the latter has a maximum size, in that the sealing rotor is constructed as a hollow cylinder. Due to the fact that the entry gap between the limiting edges 17, 19 of the sealing rotor always remains closed, even during the passage of the piston, it is ensured that no medium passes unused to the sealing rotor 4 via the deflection space. The engine is suitable for high rotational speeds, due to the fact that squeezing flows are avoided when the piston passes through the sealing rotor.

Figure 5:
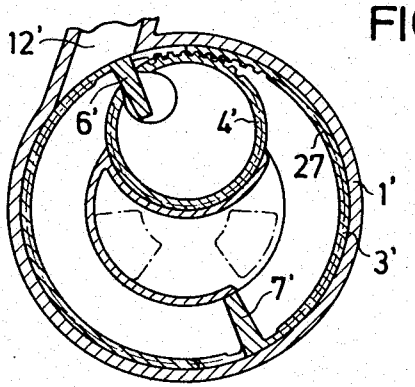
FIG. 5 is a radial section of a fourth embodiment of the rotary piston engine of the invention operating as a driver.

FIG. 5 shows a special form of the driving transmission between a piston rotor 3' and a stopping rotor 4', in that the circular cylindrical wall of the piston rotor is provided with internal teeth 27 and the sealing rotor 4' is provided with external teeth 28, whereof only a curved region is shown to simplify FIG. 5. Due to the engagement of the teeth, there is simultaneously a labyrinth-like seal between the two rotors in the engagement area.

In the case of direct or synchronous coupling between two rotary piston engines, whereof e.g. one constitutes the driver and the other the supercharger on an internal combustion engine, it is adequate if there is only a driving transmission between the piston rotor and the sealing rotor on one of these engines. Thus, the engine according to FIG. 5 can, for example, be directly coupled as the supercharger with the engine according to FIG. 2 as the driver of an internal combustion engine, in that the sealing rotor and the piston rotor are rigidly interconnected.

Figure 3:
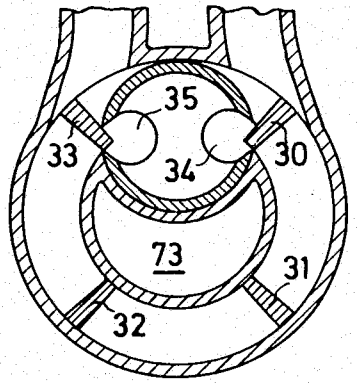
FIG. 3 is a radial section through a driver comprising a third embodiment.

Driving transmission between the piston rotor and the sealing rotor can also take place directly through the engagement of the pistons in the recesses (toothed gaps) of the sealing rotor, if the piston rotor is provided with eight pistons and the sealing rotor with four recesses. FIG. 3 shows relative to a driver, a piston rotor with four pistons 30 to 33 and a sealing rotor with two recesses 34, 35.

Figure 2:
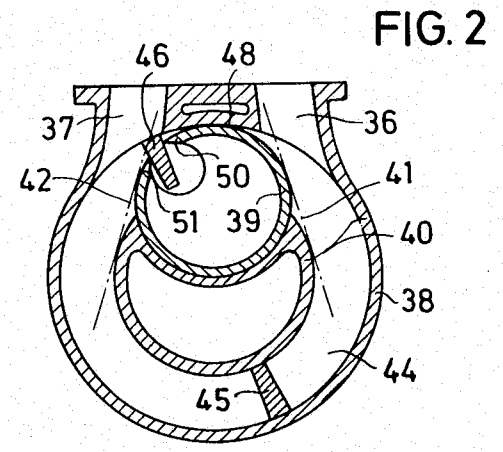
FIG. 2 is a radial section through a driver comprising a second embodiment of a rotary engine according to the invention.

On constructing the rotary piston engine as a driver according to FIGS. 2 and 3, the inflow duct 36 and outflow duct 37 for the driving medium, e.g. the exhaust of an internal combustion engine, are arranged tangentially on outer casing 38 on either side of the sealing rotor 39 in such a way that the inflow and outflow takes place tangentially to the outer face of sealing rotor 39 and to the circular cylindrically shaped casing inner wall 40, as is indicated by the dot-dash lines 41, 42 of FIG. 2. This leads to an optimum flow guidance through the annulus 44 to the drive of pistons 45,46 of the piston rotor.

In the embodiment of FIG. 2, the sealing rotor 39 has a somewhat larger diameter than half the internal diameter of the casing outer wall 38, so that the sealing rotor is in contact with the casing along a curved line 48 and a larger sealing surface is obtained between the two. Nevertheless, a diameter ratio of 2:1 is achieved in contact with the piston of the piston rotor, because through the rounded portion of opening edges 50, 51 of the sealing rotor 39, contact takes place on a correspondingly smaller diameter.

Figure 4:
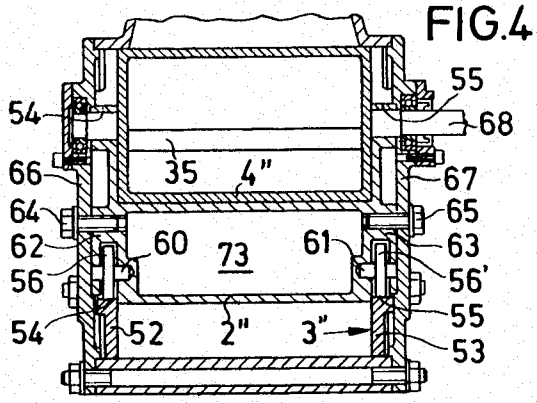
FIG. 4 is an axial section through a driver according to FIG. 3.
Figure 9:
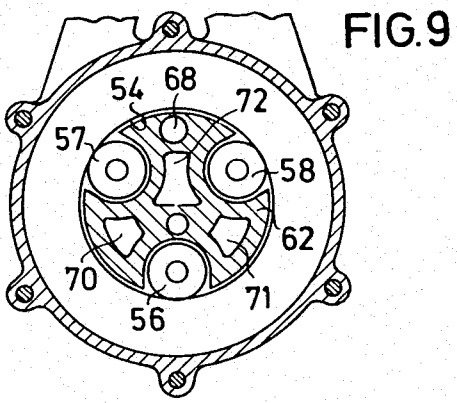
FIG. 9 is a radial section through a driver taken in the vicinity of the piston rotor bearing.

FIGS. 4 and 9 show an embodiment for the bearing of the rotors of the rotary piston engine. Piston rotor 3'' has two circular side walls 52, 53 whose circular inner faces 54, 55 form a bearing path, mounted in each case by three circumferentially equidistantly spaced rollers 56, 57, 58 or 56', 57', 58'. The bearings or journals 60, 61 of these rollers are held in a casing part 62, 63, fixed by screws 64, 65 to casing side plates 66, 67 and extending into the space surrounded by path 54, 55. Through the arrangement of individual bearing means or rollers 56–58 with a large angular reciprocal distance, shaft 68 of the sealing rotor can be circumferentially arranged between two of these rollers 57, 58, as shown in FIG. 9. The use of rollers 56 to 58 for mounting the external rotor, compared with conventional antifriction bearings, leads to greatly reduced bearing friction and consequently permits higher rotor rotation speeds. The fixed casing parts 62, 63, which receive rollers 56 to 58, can also have flow ducts 70, 71, 72, through which there can be a connection with the hollow space 73 of the inner casing, e.g. for cooling purposes. On coupling the engines according to FIGS. 4 and 6, ducts 70 to 72 can be used for the inflow of part of the intake air of the supercharger according to FIG. 1 and which is fed into the main flow via the lateral connections 74 (FIG. 6).

It is readily apparent that on the basis of the aforementioned constructional principles, numerous further embodiments of the invention are possible, corresponding to improvements to the diagrammatically represented and described engine. However, it is essential in connection with all the embodiments that an engine construction is obtained in which the working medium then flows through the medium in centrifugal machine-like manner in the direction of its rotation and the centrifugal forces which occur.

Thus, in view of the foregoing, it will be understood that the invention is directed to provision of a rotary piston engine having a piston rotating in a circular cylindrical casing whose pistons move through an annulus between an outer casing and an inner casing. The separation between the sides of higher and lower pressure of the annulus is brought about by the sealing rotor arranged in an internally axed manner and the inflow and outflow openings are arranged in a centrifugal machine-like manner, and flow duct on the outer casing being guided tangentially with respect to the outer face of the sealing rotor and the wall of the inner casing. To avoid squeezing flows, a deflection space is provided following onto the recess of the sealing rotor. Due to the fact that the part of the sealing rotor coming into contact with the piston has a diameter which is half as large as the effective external diameter of the piston rotor, even on the passage of the piston, the inner space of the sealing rotor is kept constantly closed through a continuous, two-sided contact between sealing rotor and piston, so that any undesired transfer of working medium between the inflow and outflow sides is avoided.

While specific embodiments of the invention have been shown and described in detail to illustrate the application of the inventive principles, it will be understood that the invention may be embodied otherwise without departing from such principles.

What is claimed is:

1. An internally axed crankless rotary piston engine comprising:

means forming a fixed radially inner wall and a fixed radially outer wall defining a circular annulus therebetween;

a sealing rotor having a gap which defines the terminus of said annulus at one point on its circumference;

a piston rotor having piston means including at least one piston with opposed lateral faces which moves through said circular annulus;

means defining a first opening in said inner wall;

means defining a second opening in said outer wall adjacent said sealing rotor;

one of said first and second openings comprising an inflow duct which issues into said annulus and the other of said openings comprising an outflow duct therefrom;

means defining in said sealing rotor a hollow space bounded by a pair of opening edges for passage therethrough of said piston for avoiding constricted flows, said hollow space being much larger than the kinematically necessary recess;

the speed ratio between said piston rotor and said sealing rotor being 1:2, said piston being in constant two-sided sealing contact with said opening edges of said sealing rotor while passing through said hollow space;

said opening edges of said sealing rotor having a rounded configuration whose center is always located a distance from said lateral faces of said piston equivalent to the radius of curvature of said opening edges during passage of said piston through said hollow space.

2. An internally axed crankless rotary piston engine comprising:

means forming a fixed radially inner wall and a fixed radially outer wall defining a circular annulus therebetween;

a sealing rotor having a gap which defines the terminus of said annulus at one point on its circumference;

a piston rotor having piston means including at least one piston with opposed lateral faces which moves through said circular annulus;

means defining a first opening in said inner wall;

means defining a second opening in said outer wall adjacent said sealing rotor;

said first opening comprising an inflow duct which issues into said annulus and said second opening comprising an outflow duct therefrom;

said means defining said fixed inner wall comprising an inner casing having an outlet port of said internal casing serving as said inflow duct and having an opening whose width in the circumferential direction extends from a point on the circumference of said sealing rotor up to a position corresponding to a rotation position of said piston means where said piston means has just passed said outflow duct, said piston means comprising rotating rotary pistons which move around said opening centrifugally in a blower-like manner, the opening axially having at least approximately the axial length of the piston; said piston rotor being in the form of a hollow cylinder, whose wall outwardly bounds said annulus and runs along said outer wall with the outflow from said engine taking place via openings in the wall of said piston rotor, when these coincide with said outflow duct.

3. A rotary piston engine according to claim 1, wherein said piston rotor has internal teeth, which engage with external teeth of said sealing rotor, the center of curvature of the rounded portion of the opening edges thereof being located at the intersection point of the pitch circle of said sealing rotor and an equidistant point to the lateral face of the piston.

4. A rotary piston engine according to claim 1 or 2, wherein said sealing rotor includes a shaft and wherein said piston rotor is provided with at least one circularly curved bearing part surrounding said shaft of said sealing rotor, said bearing part being mounted by a plurality of bearing means spaced in the direction of movement and which are secured by a common body.

* * * * *